US009833834B2

(12) United States Patent
Congratel et al.

(10) Patent No.: US 9,833,834 B2
(45) Date of Patent: Dec. 5, 2017

(54) TURBINE ENGINE BLADE PREFORM

(71) Applicant: Snecma, Paris (FR)

(72) Inventors: Sébastien Serge Francis Congratel, Moissy Cramayel (FR); Raphaël Jean Philippe Dupeyre, Moissy Cramayel (FR); Guillaume Klein, Moissy Cramayel (FR); David Mathieu, Moissy Cramayel (FR); Ba-Phuc Tang, Moissy Cramayel (FR)

(73) Assignee: SNECMA, Paris (FR)

( * ) Notice: Subject to any disclaimer, the term of this patent is extended or adjusted under 35 U.S.C. 154(b) by 76 days.

(21) Appl. No.: 14/895,777

(22) PCT Filed: Jun. 4, 2014

(86) PCT No.: PCT/FR2014/051324

§ 371 (c)(1),
(2) Date: Dec. 3, 2015

(87) PCT Pub. No.: WO2014/195634

PCT Pub. Date: Dec. 11, 2014

(65) Prior Publication Data

US 2016/0129497 A1 May 12, 2016

(30) Foreign Application Priority Data

Jun. 5, 2013 (FR) ..... 13 55177

(51) Int. Cl.
*B22C 9/06* (2006.01)
*B22C 9/10* (2006.01)
(Continued)

(52) U.S. Cl.
CPC ..... *B22C 9/10* (2013.01); *B22C 9/06* (2013.01); *B22C 9/22* (2013.01); *B22D 25/02* (2013.01);
(Continued)

(58) Field of Classification Search
CPC .... B22C 9/06; B22C 9/10; B22C 9/22; B22D 25/02
(Continued)

(56) References Cited

U.S. PATENT DOCUMENTS 4,421,153 A * 12/1983 Wilkinson et al. ..... B22C 9/04 164/34
5,673,745 A * 10/1997 Jackson et al. ..... B22D 19/10 148/404
(Continued)

FOREIGN PATENT DOCUMENTS

EP 0 290 773 A1 11/1988
EP 1 216 770 A2 6/2002

*Primary Examiner* — Kevin P Kerns
(74) *Attorney, Agent, or Firm* — Blank Rome LLP

(57) ABSTRACT

A blade preform includes a strut connecting a plat-form to a blade root portion extending longitudinally in an upstream-downstream direction, an upstream web and a downstream web, which each extend in a direction substantially perpendicular to the longitudinal direction of the blade root and are formed at the upstream and downstream ends of the strut. The upstream and downstream webs connect the upstream and downstream ends of the plat-form to the upstream and downstream ends of the blade root. The blade root extends in a direction perpendicular to the longitudinal direction of the blade root over a distance smaller than that of the upstream and downstream webs and the side edges of each web are extended by walls that converge at the flanks of the blade root.

5 Claims, 3 Drawing Sheets

(51) Int. Cl.
*B22C 9/22* (2006.01)
*B22D 25/02* (2006.01)
*F01D 5/14* (2006.01)

(52) U.S. Cl.
CPC ..... *F01D 5/141* (2013.01); *F05D 2230/21* (2013.01); *F05D 2230/61* (2013.01)

(58) Field of Classification Search
USPC ..... 164/69.1, 159, 349
See application file for complete search history.

(56) References Cited

U.S. PATENT DOCUMENTS

| | | | | |
|---|---|---|---|---|
| 6,186,867 | B1 | 2/2001 | Dwyer | |
| 2006/0021730 | A1* | 2/2006 | Marcin, Jr. | B22C 9/04 164/122.1 |
| 2006/0130553 | A1* | 6/2006 | Roth-Fagaraseanu | B21J 5/02 72/377 |
| 2009/0324841 | A1* | 12/2009 | Arrell et al. | C23C 4/02 427/446 |
| 2013/0101429 | A1* | 4/2013 | Roussille et al. | F01D 5/147 416/230 |
| 2013/0302171 | A1* | 11/2013 | Illand et al. | F01D 5/3007 416/220 R |
| 2014/0154082 | A1* | 6/2014 | Shinn et al. | B23K 1/0018 416/191 |

* cited by examiner

TURBINE ENGINE BLADE PREFORM

CROSS-REFERENCE TO RELATED APPLICATIONS

This application is a national stage of International Application No. PCT/FR2014/051324, filed on Jun. 4, 2014, which claims the benefit of French Patent Application 1355177, filed Jun. 5, 2013, the contents of each of which are incorporated herein by reference.

BACKGROUND OF THE INVENTION

The invention relates to a turbine engine blade preform, such as in particular a turbine blade preform in a turbine engine, and a mold and a method for obtaining the blade preform.

In the current technique, the turbine blades are one-piece parts obtained by molding, using a mold comprising a cavity, the three-dimensional shape of which makes it possible to obtain the desired shape in a form-fitting manner. In practice, the part obtained after the step of molding consists of a blade preform which has to be machined to reach the desired final shape and dimensions.

Thus, a turbine blade preform comprises a strut connecting a blade root to a plat-form. The blade preform also has two transverse upstream and downstream webs formed at the upstream and downstream ends of the strut and connecting the upstream and downstream edges of the plat-form to the upstream and downstream ends of the blade root, respectively. It should be noted that the terms "upstream" and "downstream" are to be considered relative to a general upstream to downstream fluid flowing direction around the blade when the latter is mounted in a turbine engine.

When viewed in an upstream/downstream direction, each web of the blade comprises side edges connected to the blade root flanks through concave curved walls which extend towards each other and form a throat area the width of which measured in a transverse direction is smaller than that of the blade root.

The presence of a throat at the junction between each web and the blade root makes it possible to limit the time required for the final machining of the blade root. To obtain such above-mentioned throats, the mold must also comprise the matching throat areas.

However, when the liquid material flows into the mold, the mold throat areas slow down the flow of material at these locations, which may lead to interrupted solidification and cold lap which may lead to a poor solidification of the material and the forming of mechanical defects, such as cracks in the connecting areas of the side webs to the preform of the blade root.

SUMMARY OF THE INVENTION

The present invention provides a simple, efficient and economical solution to such problems.

To this end, it provides a turbine engine blade preform, with the preform comprising a strut connecting a platform to a blade root portion extending longitudinally in an upstream-downstream direction, two upstream and downstream webs, which extend in a direction substantially perpendicular to the longitudinal direction of the blade root and are formed at the upstream and downstream ends of the strut, with such upstream and downstream webs connecting the upstream and downstream ends of the platform to the upstream and downstream ends of the blade root, characterized in that the blade root extends in a direction perpendicular to the longitudinal direction of the blade root over a distance smaller than that over which the upstream and downstream webs extend and in that the side edges are extended by walls that converge at the flanks of the blade root.

Forming side edges converging towards each other at the connection areas of each web at the blade root makes it possible, when casting the material into an appropriate mold, to obtain optimum metallurgical quality at such connecting regions since the material flows into the mold without any throat zone like in the prior art.

Thus, the rate of rejection of blade preforms obtained by molding is greatly reduced, which reduces the manufacturing costs of the blades.

Said converging walls are preferably formed by plane faces inclined with respect to a median plane of the blade root extending longitudinally in an upstream/downstream direction.

According to a particular embodiment of the invention, the above-mentioned faces are inclined at an angle of approximately 45° with respect to the median plane.

The invention also relates to a mold for manufacturing a casting blade preform as described above, comprising an internal cavity the three-dimensional shape of which determines, in a form-fitting manner, the three-dimensional shape of the blade preform, with the mold comprising at least two first and two second blocks arranged in pairs opposite each other along perpendicular axes, with the first two cavity retainer blocks each comprising a recess having a boss intended to define the inner surface of a platform of the preform and the blade defining, with recesses of the second cavity retainer blocks, spaces intended to form upstream and downstream side webs for connecting upstream and downstream edges of a plat-form of the blade preform to the upstream and downstream ends of a blade root, with the first cavity retainer blocks further comprising substantially parallel and opposed faces intended to form flanks of a root part of the blade preform, characterized in that the recess of each first block comprises first and second surfaces on either side of the boss connected to the face forming a flank of the blade root, with the first and the second surfaces of the first cavity retainer blocks converging toward the faces of the flanks of the blade root.

According to the invention, the integration of first and second converging surfaces prevents the forming of a throat in the connecting regions of the side webs to the blade root, thereby limiting the forming of defects in these areas.

The invention also relates to a method for manufacturing a turbine blade using the mold described above, comprising:

a. positioning the mold so that the first and second cavity retainer blocks are arranged in an upper position relative to a lower mold part;
b. gradually introducing a liquid material into the lower part of the mold so that the liquid level gradually increases inside the mold and forms a blade preform, in a form-fitting manner; then
c. performing a finishing machining of the blade preform to the desired final dimensions of the blade.

BRIEF DESCRIPTION OF THE DRAWINGS

The invention will be better understood, and other details, characteristics and advantages thereof will appear upon reading the following description given by way of a non-restrictive example while referring to the appended drawings wherein.

DETAILED DESCRIPTION OF THE INVENTION

Figure 1:
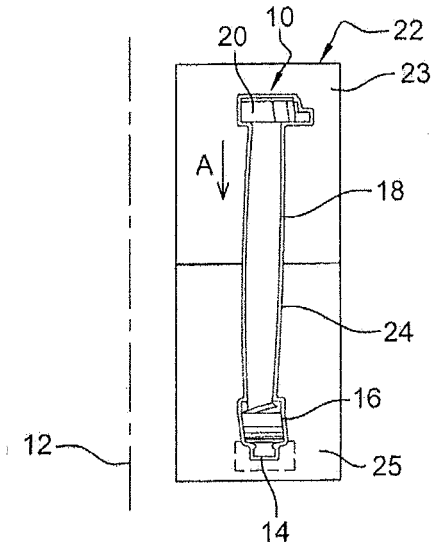
Fig. 1 (PRIOR ART)
FIG. 1 is a schematic view of a turbine engine blade preform according to the prior art.

Reference will first be made to FIG. 1 which shows a one-piece turbine engine blade preform 10 according to the prior art obtained by molding in a mold and comprising, along the axis 12, a portion of the blade root 14 which extends longitudinally in an upstream/downstream direction and having, in cross-section, a substantially rectangular shape, a plat-form 16, a blade 18 and a blade root 20. From upstream or downstream, the outline of the root is U-shaped, with the branches of the U being substantially parallel and being formed by the flanks 42 of the blade root. The blade shown in FIG. 1 more particularly represents a blade mounted in a turbine of the turbine engine.

The mold 22 comprises an internal cavity 24, the three-dimensional shape of which is so determined that the desired three-dimensional shape of the blade preform 10 is obtained by filling the mold with the liquid material. In practice, the liquid material is injected into the mold 22 from a lower portion 23 of the mold 12 corresponding to the one making it possible to obtain the blade root 20. The liquid material progressively fills the mold (A arrow) up to an upper portion 25 of the mold corresponding to the one making it possible to obtain a blade root portion 14. In FIG. 1, and for a usual representation of the blade, the mold 22 is thus shown in the reversed position relative to its position of use.

Figure 2:
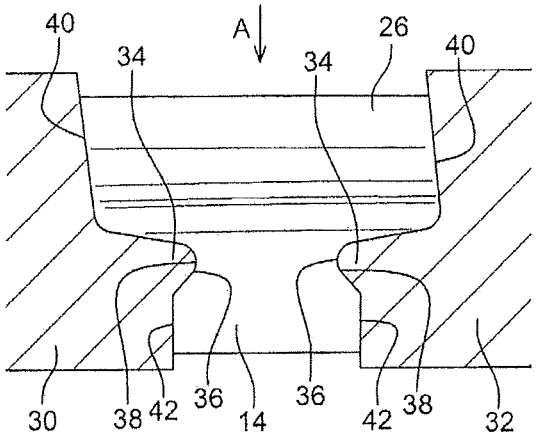
Fig. 2 (PRIOR ART)
FIG. 2 is a view from upstream of the area enclosed in dotted lines in FIG. 1.
Figure 3:
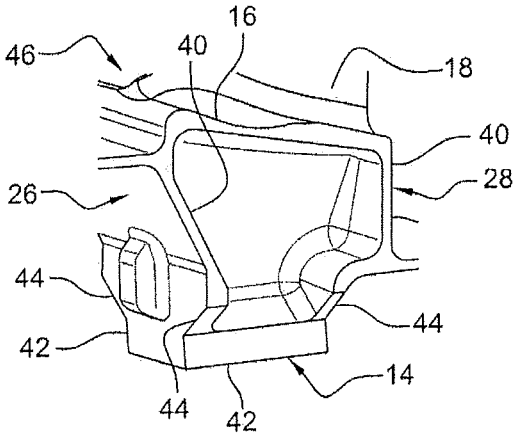
FIG. 3 is a schematic view, in perspective, of a turbine engine blade preform according to the invention.

FIG. 2 shows the part in dotted lines in FIG. 1, i.e. the internal part of the blade preform comprising two upstream 26 and downstream 28 webs extending in a direction substantially perpendicular to the longitudinal direction of the blade root 14, with the two upstream 26 and downstream 28 webs connecting the root portion of the blade root 14 to the plat-form 16 (only the upstream 26 web is shown in FIG. 2, with the downstream 28 web being visible in FIG. 3 illustrating the invention). FIG. 2 also schematically shows two cavity retainer blocks 30, 32 of the mold 22, arranged in facing relation and each comprising a protruding portion 34 towards one another, with such portions 34 comprising convex curved surfaces 36 making it possible to form, in a form-fitting manner, concave curved walls 38 connecting the side edges 40 of the webs 26, 28 to the portion of the blade root 14.

As explained above, this type of blade preform may have mechanical defects such as cracks, at the connecting areas 38 of the webs 26, 28 to the flanks 42 of the root portion 14 of the blade preform 10 due to the presence of a throat zone in the mold between the two parts 34 which slows down the flow of material (A arrow).

The invention thus provides a modification of the connecting regions of the side edges of the webs 26, 28 to the flanks 42 of the blade root by extending the side edges 40 of the webs 44 by walls converging towards one another up to the flanks 42 of the blade root 14 as shown in FIG. 3. The blade root 14 thus extends in a direction substantially perpendicular to the longitudinal upstream/downstream direction of the blade root over a distance smaller than that of the upstream 26 and downstream 28 webs. Unlike the prior art, the preform blade 46 no longer comprises a throat area, which greatly reduces the risks of formation of defects at the junction of the webs 26, 28 with the portion of the blade root 14.

In the embodiment shown in FIG. 3, the walls 44 are formed by flat surfaces inclined at an angle of approximately 45° relative to a median plane of the blade root extending from upstream to downstream, i.e. a plane extending longitudinally through the centre of the blade root 14.

In other not shown embodiments, the walls may be curved, concave or convex, while converging towards the flanks of the blade root.

Figure 4:
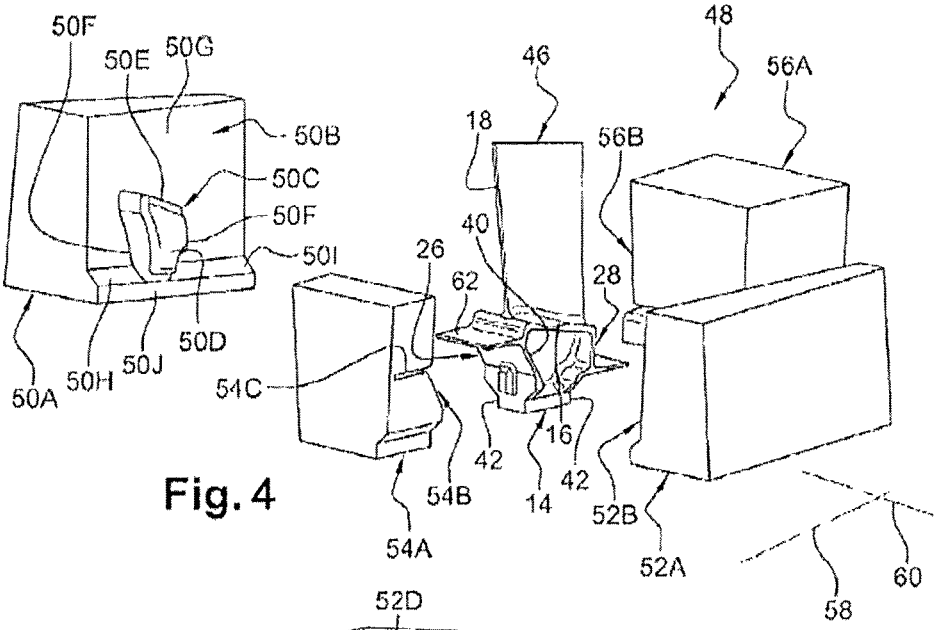
FIGS. 4 to 6 are schematic representations in perspective of several cavity retainer blocks of a tool for making a preform according to the invention.
Figure 5:
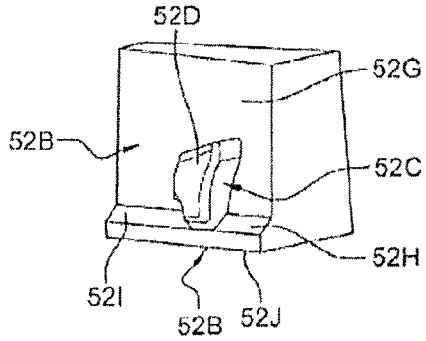
Figure 6:
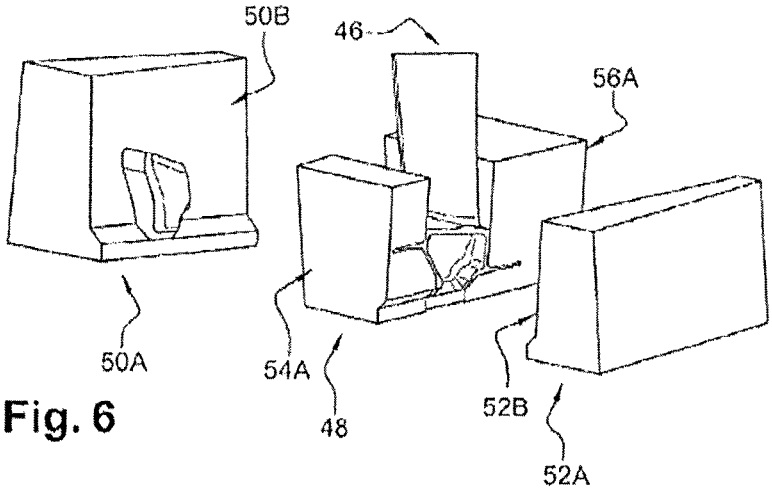
Figure 7:
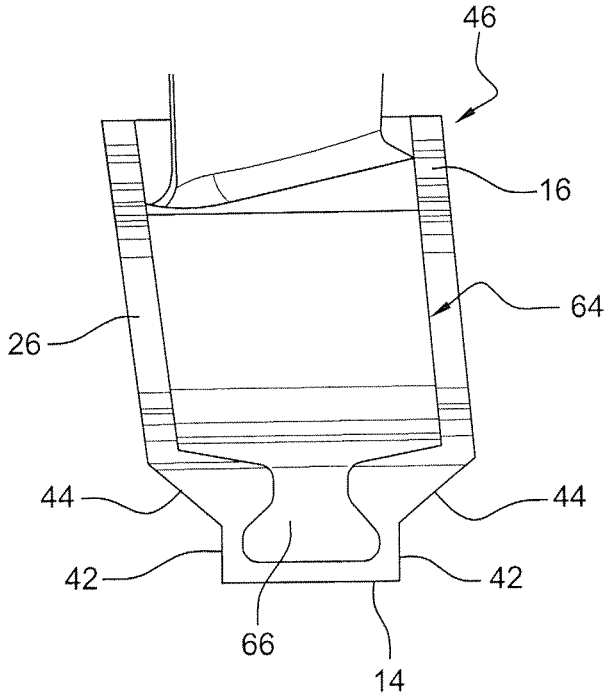
FIG. 7 is a view from upstream simultaneously representing in superposition a turbine blade preform of the invention and a turbine engine blade obtained after machining the preform.
Figure 8:
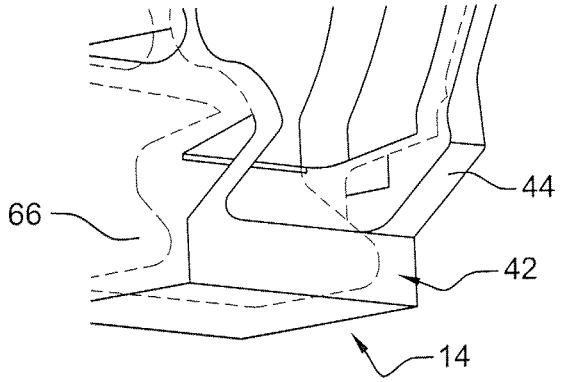
FIG. 8 is a schematic view, in perspective, simultaneously showing in superposition a turbine blade preform according to the invention and a turbine engine blade obtained after machining the preform.

Reference is now made to FIGS. 4 to 6 showing a portion of a mold 48 according to the invention for forming the connecting regions with convergent faces as described with reference to FIG. 3.

This mold comprises two first 50A, 52A and two second 54A, 56A cavity retainer blocks arranged in pairs opposite one another along perpendicular axes 58, 60 (FIG. 4). Each cavity retainer block 50A, 52A, 54A, 56A comprises a recess 50B, 52B, 54B, 56B delimiting a cavity intended to form, in a form-fitting manner, a portion of the turbine blade preform 46 in a form-fitting manner, after assembling the cavity retainer blocks 50A, 52A, 54A, 56A.

In particular, the recess 50B of the block 50A comprises a boss 50C an outer surface 50D of which is arranged with some clearance opposite an outer surface 52D of a matching boss 52C of the recess 52B of the block 52A so as to form the strut of the blade preform 46. Each outer surface 50D, 52D of a boss 50C, 52C is connected to the rest of the recess 50B, 52B by a periphery an upper surface 50E of which is intended to delimit an inner face of the plat-form 16, two side surfaces 50F are intended to form the upstream 26 and downstream 28 side webs of the blade preform 46 with the recesses 54B, 56B of the second cavity retainer blocks 54A, 56A.

The boss 50C, 52C of each recess 50B, 52B of a first block protrudes from a surface 50G, 52G intended to form the side edges of the plat-form 16 and the side edges 40 of the upstream 26 and downstream 28 webs of the plat-form 16. This area 50G, 52G is connected to a first 50H, 52H and a second 50I, 52I surfaces extending on either side of the boss 50D, 52D and intended to form the connecting regions to the blade root 14 according to the invention. For this purpose, the first surfaces 50H, 52H of the cavity retainer blocks 50B, 52B converge towards one another in a direction oriented from the impeller 18 to the blade root 14. Similarly, the second surfaces 50I, 52I converge towards one another in a impeller to blade root direction. The first surface 50H, 52H and the second surface 50I, 52H of each cavity retainer block 50A, 52A are connected to the same surface 50J, 52J intended to form a flank 42 of a portion of the blade root 14. These surfaces of the first cavity retainer blocks 50A, 52A forming the above-mentioned flanks are substantially parallel.

Forming converging faces opening onto parallel faces 50J, 52J on the first and second cavity retainer blocks facilitates the flow of liquid material into the mold (A arrow).

It should be noted that the second cavity retainer blocks 54A, 56A each comprise a slot 54C for forming a spoiler 62 extending from a side web 26, 28 of the blade preform 46 and opposite the plat-form 16 relative to the web.

After molding the preform 46 using the mold described above, a machining operation of the preform is carried out so as to obtain a turbine blade 64 to the desired dimensions. A machining of the part of the blade root and the connection zones of the side webs to the part of the blade root is executed so as to form a dovetail blade root 66 adapted to be axially engaged and radially retained in a cavity of a turbine disk in a well known manner. The step of machining also consists in machining the side edges of the plat-form.

The invention claimed is:

1. A turbine engine blade preform, with the preform comprising a strut connecting a plat-form to a blade root portion extending longitudinally in an upstream-downstream direction, an upstream web and a downstream web, which each extends in a direction perpendicular to a longitudinal direction of the blade root and are formed at upstream and downstream ends of the strut, with such upstream and downstream webs connecting the upstream and downstream ends of the plat-form to the upstream and downstream ends of the blade root, characterized in that the blade root extends in a direction perpendicular to the longitudinal direction of the blade root over a distance smaller than that over which the upstream and downstream webs extend in said longitudinal direction and in that the upstream and downstream webs each comprises two side edges which are extended by converging walls at flanks of the blade root.

2. The preform according to claim 1, wherein said converging walls are formed by plane faces inclined with respect to a median plane of the blade root extending longitudinally along an upstream/downstream direction.

3. The preform according to claim 2, wherein the plane faces are inclined at an angle of approximately 45° with respect to the median plane of the blade root.

4. A mold for manufacturing a casting blade preform according to claim 1, comprising an internal cavity, a three-dimensional shape of which determines, in a form-fitting manner, a three-dimensional shape of the blade preform, with the mold comprising at least two first cavity retainer blocks and two second cavity retainer blocks arranged in pairs opposite each other along perpendicular axes, with the two first cavity retainer blocks each comprising a recess having a boss intended to define an inner surface of a plat-form of the preform and the blade defining, with recesses of the two second cavity retainer blocks, spaces intended to form upstream and downstream side webs for connecting upstream and downstream edges of a plat-form of the blade preform to the upstream and downstream ends of a blade root, with the first cavity retainer blocks further comprising parallel and opposed faces intended to form flanks of a root part of the blade preform, characterized in that the recess of each first block comprises first and second surfaces on either side of the boss connected to the face forming a flank of the blade root, with the first and the second surfaces of the first cavity retainer blocks converging toward the faces of the flanks of the blade root.

5. The method for manufacturing a turbine blade using the mold according to claim 4, the method comprising:

a. positioning the mold so that the first and second cavity retainer blocks are arranged in an upper position relative to a lower mold part;

b. gradually introducing a liquid material into the lower part of the mold so that a liquid level gradually increases inside the mold and forms a blade preform, in a form-fitting manner; and then c. performing a finishing machining of the blade preform to obtain desired final dimensions of the blade.

* * * * *